US010591238B1

(12) United States Patent
Bader

(10) Patent No.: US 10,591,238 B1
(45) Date of Patent: Mar. 17, 2020

(54) FIREARM NOISE SUPPRESSOR

(71) Applicant: Wade Bader, Tampa, FL (US)

(72) Inventor: Wade Bader, Tampa, FL (US)

( * ) Notice: Subject to any disclaimer, the term of this patent is extended or adjusted under 35 U.S.C. 154(b) by 0 days.

(21) Appl. No.: 16/350,634

(22) Filed: Dec. 12, 2018

(51) Int. Cl.
*F41A 21/30* (2006.01)

(52) U.S. Cl.
CPC ..... *F41A 21/30* (2013.01)

(58) Field of Classification Search
CPC ..... F41A 21/30; F41A 21/32; F41A 21/325; F41A 21/34; F41A 21/36
USPC ..... 89/14.4, 14.3; 181/223
See application file for complete search history.

(56) References Cited

U.S. PATENT DOCUMENTS 5,679,916 A * 10/1997 Weichert ..... F41A 21/30 181/223
6,308,609 B1 * 10/2001 Davies ..... F41A 21/30 181/223
6,374,718 B1 * 4/2002 Rescigno ..... F41A 21/30 89/14.4
7,073,426 B1 * 7/2006 White ..... F41A 21/30 181/223
7,587,969 B2 * 9/2009 Silvers ..... F41A 21/30 181/223
7,856,914 B2 * 12/2010 Shults ..... F41A 21/30 181/223
8,100,224 B1 * 1/2012 Olson ..... F41A 21/30 181/212
8,910,745 B2 * 12/2014 Latka ..... F41A 21/30 181/223
8,939,057 B1 * 1/2015 Edsall ..... F41A 21/30 181/223
8,967,325 B1 * 3/2015 Cronhelm ..... F41A 13/00 181/223
8,973,481 B2 * 3/2015 Dueck ..... F41A 21/325 181/223
9,482,484 B2 * 11/2016 Barney ..... F41A 21/30
9,714,805 B1 * 7/2017 Lau ..... F41A 21/30
9,921,020 B2 * 3/2018 Latka ..... F41A 21/30
9,982,959 B2 * 5/2018 Washburn, III ..... F41A 21/30
10,119,779 B1 * 11/2018 Miele ..... F41A 21/30
10,126,084 B1 * 11/2018 Oglesby ..... F41A 21/30
10,480,888 B2 * 11/2019 Barrett ..... F41A 21/30
(Continued)

*Primary Examiner* — Derrick R Morgan
(74) *Attorney, Agent, or Firm* — Arthur W. Fisher, III

(57) ABSTRACT

A firearm noise suppressor comprising a plurality of axially aligned cups or hollow members constructed of fibrous material impregnated with an epoxy resin cooperatively forming a plurality of chambers encased in an outer sleeve and a method for producing the firearm noise suppressor comprising the steps of individually forming each of the cups or hollow members from a fibrous material having a centrally disposed aperture formed therethrough, impregnating each cup or hollow member with epoxy resin, placing each impregnated fibrous cup or hollow member on an alignment tool by aligning the centrally disposed apertures of the plurality of fibrous hollow members on the alignment tool such that each fibrous cup or hollow member contacts the next adjacent fibrous cup or hollow member, encasing the plurality of fibrous cups or hollow members in the outer sleeve with an epoxy resin to bond the fibrous cups or hollow members together to form the firearm noise suppressor and removing the firearm noise suppressor from the alignment tool.

11 Claims, 14 Drawing Sheets

(56) References Cited

U.S. PATENT DOCUMENTS

2007/0107590 A1* 5/2007 Silvers ..... F41A 21/30 89/14.4
2010/0000398 A1* 1/2010 Silvers ..... F41A 21/30 89/14.4
2010/0180759 A1* 7/2010 Petersen ..... F41A 21/30 89/14.4
2011/0067950 A1* 3/2011 Shults ..... F41A 21/30 181/223
2012/0145478 A1* 6/2012 Brittingham ..... F41A 21/30 181/223
2012/0152093 A1* 6/2012 Koumbis ..... F41A 21/30 89/14.4
2012/0272818 A1* 11/2012 Dueck ..... F41A 21/30 89/14.4
2013/0025439 A1* 1/2013 Orton ..... F15C 1/16 89/14.2
2014/0224575 A1* 8/2014 Latka ..... F41A 21/30 181/223
2014/0262605 A1* 9/2014 Washburn, III ..... F41A 21/30 181/223
2015/0101882 A1* 4/2015 Moss ..... F41A 21/30 181/223
2015/0285575 A1* 10/2015 Sclafani ..... F41A 21/30 181/223
2016/0018178 A1* 1/2016 Johansen ..... F41A 21/30 181/223
2017/0160035 A1* 6/2017 Piemme ..... F41A 21/30
2017/0299313 A1* 10/2017 Adamson, Jr. ..... F41A 21/30
2017/0299314 A1* 10/2017 Palu ..... F41A 21/30
2017/0307323 A1* 10/2017 Couvillion ..... F41A 21/34
2018/0031346 A1* 2/2018 Washburn, III ..... F41A 21/30
2018/0164065 A1* 6/2018 Mohler ..... F41A 21/30
2018/0202744 A1* 7/2018 De Sousa ..... F41A 21/30
2018/0306544 A1* 10/2018 White ..... F41A 21/38
2018/0321008 A1* 11/2018 Barney ..... F41A 21/30
2018/0372438 A1* 12/2018 Washburn, III ..... F41A 21/30
2019/0063859 A1* 2/2019 Gilpin ..... F41A 21/30

* cited by examiner

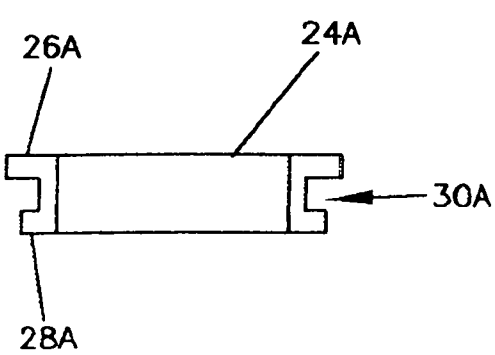
FIG. 4
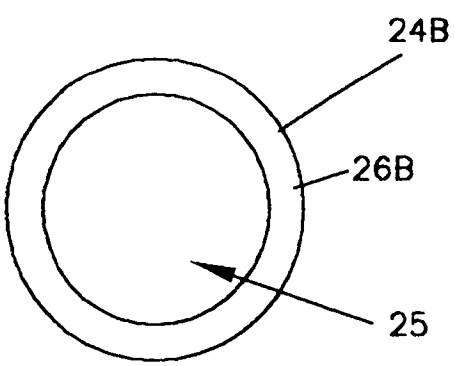
FIG. 5
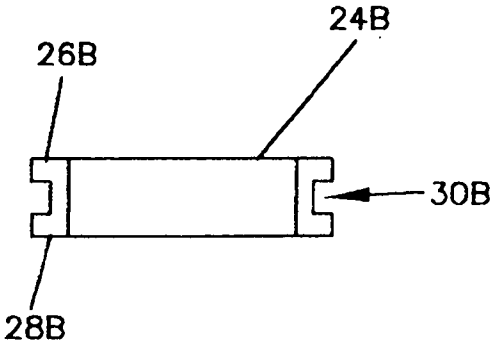
FIG. 6
FIG. 7
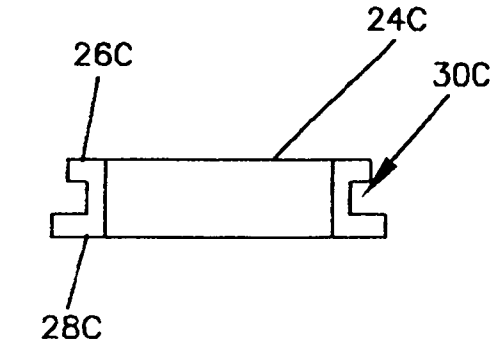
FIG. 8
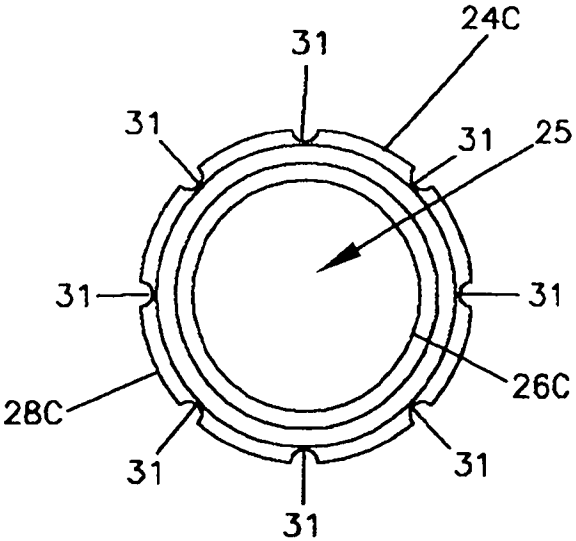
FIG. 9

FIREARM NOISE SUPPRESSOR

BACKGROUND OF THE INVENTION

Field of the Invention

A firearm noise suppressor and method of producing the firearm noise suppressor formed by a plurality of fibrous hollow members bonded together within an outer sheath or shell.

Description of the Prior Art

Examples of firearm noise suppressors are found in abundance. The following examples are believed representative of the prior art most similar to the invention defined and described herein.

U.S. Pat. No. 9,476,661 relates to a suppressor for reducing muzzle blasts in firearms includes a mounting apparatus with a rear end designed to mate with a firearm barrel. A plurality of baffles each including aligning and joining features mating one baffle with the blast cap and the remaining baffles to each other. Each baffle includes a plate having gas ports therethrough positioned within a cylindrically shaped sidewall. The mounting apparatus, the blast cap, the plurality of baffles, and the end cap are affixed together using the aligning and joining features to form the suppressor.

US 2012/0152093 discloses an assembly for a firearm including a sleeve connected to the receiver or receiver end of the barrel. The sleeve extends beyond the discharge end of the barrel and includes inwardly extending projections abutting or juxtaposed to a peripheral section of the discharge end of the barrel. A noise suppressor threads onto the sleeve. Some of the propellant gases are redirected and cooled by the noise suppressor in a conventional manner. Some of the propellant gases are redirected into an annulus between the barrel and sleeve where they are cooled and some of their volume is reduced thereby increasing the efficiency of the noise suppressor.

U.S. Pat. No. 7,325,474 describes a silencer comprises a casing cylinder and a segment member housed in the casing cylinder to constitute a sound reducing means. The silencer further comprises a segment member fastening means for fastening the segment member to the casing cylinder, a gas inlet-side lid plate with a punched hole, which closes an opening at one end of the casing cylinder, and a gas outlet-side lid plate with a punched hole, which closes an opening at the other end of the casing cylinder. At least either one of the gas inlet-side lid plate or the gas outlet-side lid plate is adapted to be detachable from the casing cylinder.

US 2016/0209152 shows a sound suppressor for a firearm including a baffle; a spacer abutted to the baffle; and a circumferential laser weld joining the baffle and the spacer. The sound suppressor may include a plurality of baffles; a plurality of spacers; a substantially tubular housing surrounding the baffles and the spacers wherein the housing and the spacers define an annular volume surrounding the spacers. An aperture is adapted to direct combustion gases in a radial direction from within the spacer into the annular volume to reduce ejection port flash of the firearm.

U.S. Pat. No. 8,973,481 discloses a firearm sound suppressor comprising a housing, a baffle, and an inner sleeve configured to be disposed within the housing and to substantially surround the baffle. The inner sleeve includes a sidewall adapted to slide against the housing to permit the inner sleeve with the baffle to be selectively inserted into and removed from the housing without the baffle contacting the housing. A longitudinal split extends through the sidewall and between the front and rear ends of the inner sleeve to permit the sidewall to flex to permit removal of the baffle from the inner sleeve.

U.S. Pat. No. 6,374,718 relates to a silencer for a shotgun firearm comprising a metal body tube, a frontend closure having a projectile exit guide, and a rear end closure having a barrel mounting element. A plurality of conical baffles with metal guide bushings are serially positioned in the body and arranged coaxially with the bore of the shotgun barrel. The guides are spaced apart a distance less than the axial length of the shot cup of the shotgun projectile. An expansion chamber is provided in the body rearwardly of the muzzle where the muzzle gasses are initially discharged into the body.

U.S. Pat. No. 7,749,423 shows a method of producing a device comprising impregnating a fibrous carbon graphite fabric with epoxy resin and allowing the epoxy resin to harden in the fibrous carbon graphite fabric.

Additional examples of the prior art are found in U.S. Pat. Nos. 3,385,164; 7,789,008; 7,856,914; 8,096,222; 8,991,550; 9,366,495; 9,482,484; 9,677,839; 9,714,805; 9,746,267; US 2012/0272818; US 2016/0018178 and US 2016/0187093.

While some of the prior art may contain some similarities relating to the present invention, none of them teach, suggested or include all of the advantages and unique features of the invention disclosed hereafter.

SUMMARY OF THE INVENTION

The present invention relates to a firearm noise suppressor for use with a firearm and a method of producing the firearm noise suppressor.

The firearm noise suppressor comprises a plurality of axially aligned hardened cups or hollow members cooperatively forming a plurality of expansion chambers.

Each hardened cup or hollow member comprises an end including a centrally disposed aperture formed therethrough having a skirt or apron depending from the corresponding end to cooperatively form a cavity. When assembled, the end and annular skirt of the adjacent cup or hollow member cooperatively form a corresponding expansion chamber.

An aperture reinforcing member or grommet including a centrally disposed aperture may be secured to each end to protect the periphery of the corresponding centrally disposed aperture of the corresponding hardened cup or hollow member.

The aperture reinforcing member or grommet of the proximal cup or hollow member comprises an internally threaded anchor nut to secure the firearm noise suppressor to the muzzle by a threaded protrusion on the firearm.

The hardened cups or hollow members may be fabricated from a blank of fibrous material comprising graphite, carbon, Kevlar, fiberglass or other similar commercially available fabric capable of absorbing a liquified resin which when cured form the hardened cups or hollow member. The resin may comprise polyamide, bismaleimide (BMI) or epoxy, or a combination of two (2) or more of these resins.

The method of producing the hardened fibrous cups or hollow members from blanks of fibrous material comprises the steps of:

creating a mold having an alignment tool or post extending upwardly therefrom upon which to shape a blank of fibrous material into a fibrous cup or hollow member;

placing a piece or sheet of nonstick film over the mold;

placing a piece or sheet of resin film over the piece or sheet of nonstick film;

positioning the blank of fibrous material onto the alignment tool or post and mold by aligning the centrally disposed aperture of the aperture reinforcing member or grommet secured to the periphery of the centrally disposed aperture of the blank of fibrous material on the alignment tool or post extending upwardly from the mold;

shaping or conforming the blank of fibrous material to the mold to form the cup or hollow member to form a cavity;

placing the cup or hollow member and mold in an enclosure;

heating the enclosure to liquefy resin into the fibers of the blank of fibrous material in the shape of the cup or hollow member to impregnate the fibers with the liquified resin;

removing the resin impregnated fibrous cup or hollow member and mold from the enclosure;

allowing the resin to cure or harden to form the hardened fibrous cup or hollow member; and removing the hardened fibrous cup or hollow member from the mold.

The blank of fibrous material may be impregnated with resin or a sheet of resin fiber may be placed over the mold.

The method of producing the firearm noise suppressor comprises the steps of fabricating hardened fibrous cups or hollow members and then bonding a plurality of the hardened fibrous cups or hollow members within a sheath or shell.

In particular, the steps of bonding a plurality of hardened cups or hollow members within a sheath or shell comprise:

stacking a plurality of hardened fibrous cups or hollow members on a alignment jig by placing each of the hardened fibrous cups or hollow members on a post extending up from a base of the alignment jig by passing the post through the centrally disposed aperture reinforcing member or grommet of each hardened fibrous cup or hollow member such that the outer periphery of each annular skirt or apron engages the adjacent hardened fibrous cup or hollow member to cooperatively form an expansion chamber;

covering the plurality of stacked hardened fibrous cups or hollow members with fibrous tubular braid coated or embedded with a resin and/or plurality of single and multidirectional fibers coated with resin;

wrapping the proximal end portion of the proximal hardened fibrous cup or hollow member with a unidirectional tie down;

placing the plurality of stacked and hardened fibrous cups or hollow members, fibrous tubular braid and jig in an enclosure;

heating the enclosure to liquefy the resin to bond the stacked hardened fibrous cups or hollow members together;

removing the hardened fibrous cups or hollow members and jig from the enclosure;

allowing the resin on outer surface of the stacked hardened fibrous cups or hollow members to cure and harden to create a composite sheath with the anchor nut secured to the proximal end portion thereof; and removing the firearm noise suppressor from the alignment tool.

This summary is not intended to describe essential features of the claimed subject matter nor is it intended to limit the scope of the claimed subject matter. To the contrary, this Summary merely outlines various concepts and features that are developed in the Detailed Description.

BRIEF DESCRIPTION OF THE DRAWINGS

For a fuller understanding of the nature and object of the invention, reference should be had to the following detailed description taken in connection with the accompanying drawings in which:

FIG. 4 is a side view of the distal or exit aperture reinforcing member to be integrally formed with the distal cup or hollow member of the present invention.

FIG. 5 is an end view of the distal or exit aperture reinforcing member to be integrally formed with the distal cup or hollow member of the present invention.

FIG. 6 is a side view of the internal aperture reinforcing member to be integrally formed with the internal cup or hollow member of the present invention.

FIG. 7 is an end view of the internal aperture reinforcing member to be integrally formed with the internal cup or hollow member of the present invention.

FIG. 8 is a side view of the proximal or entry aperture reinforcing member to be integrally formed with the proximal cup or hollow member of the present invention.

FIG. 9 is an end view of the proximal or entry aperture reinforcing member integrally formed with the proximal cup or hollow member of the present invention.

Similar reference characters refer to similar parts throughout the several views of the drawings.

DETAILED DESCRIPTION OF THE INVENTION

Figure 1:
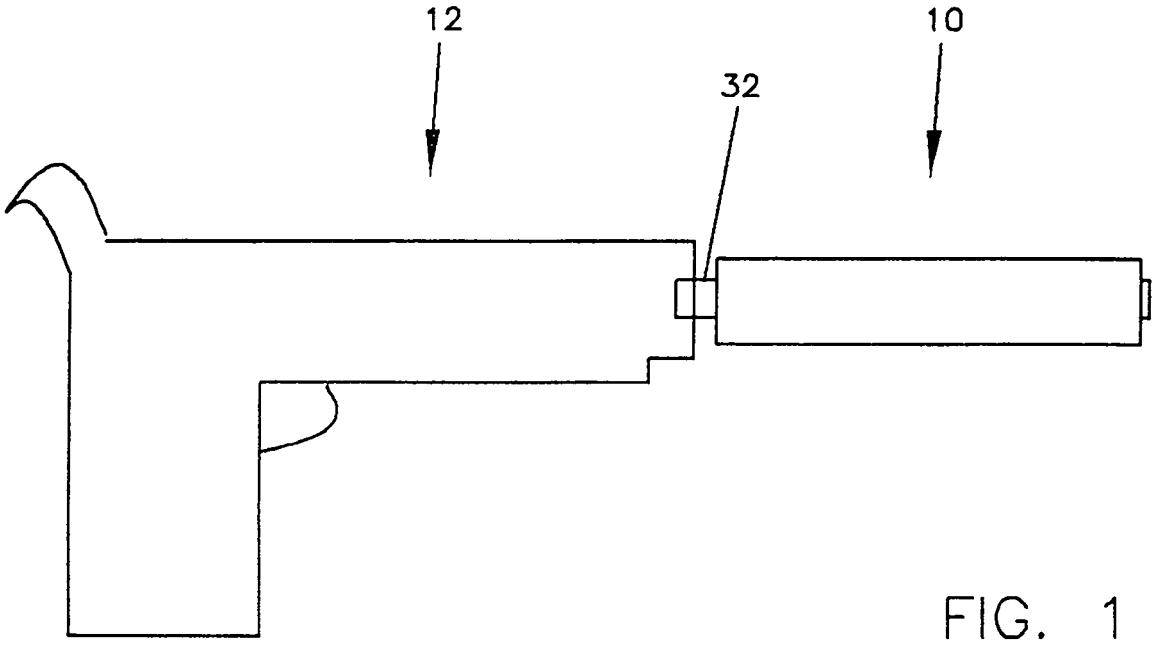
FIG. 1 is a side view of the firearm noise suppressor of the present invention.
Figure 2:
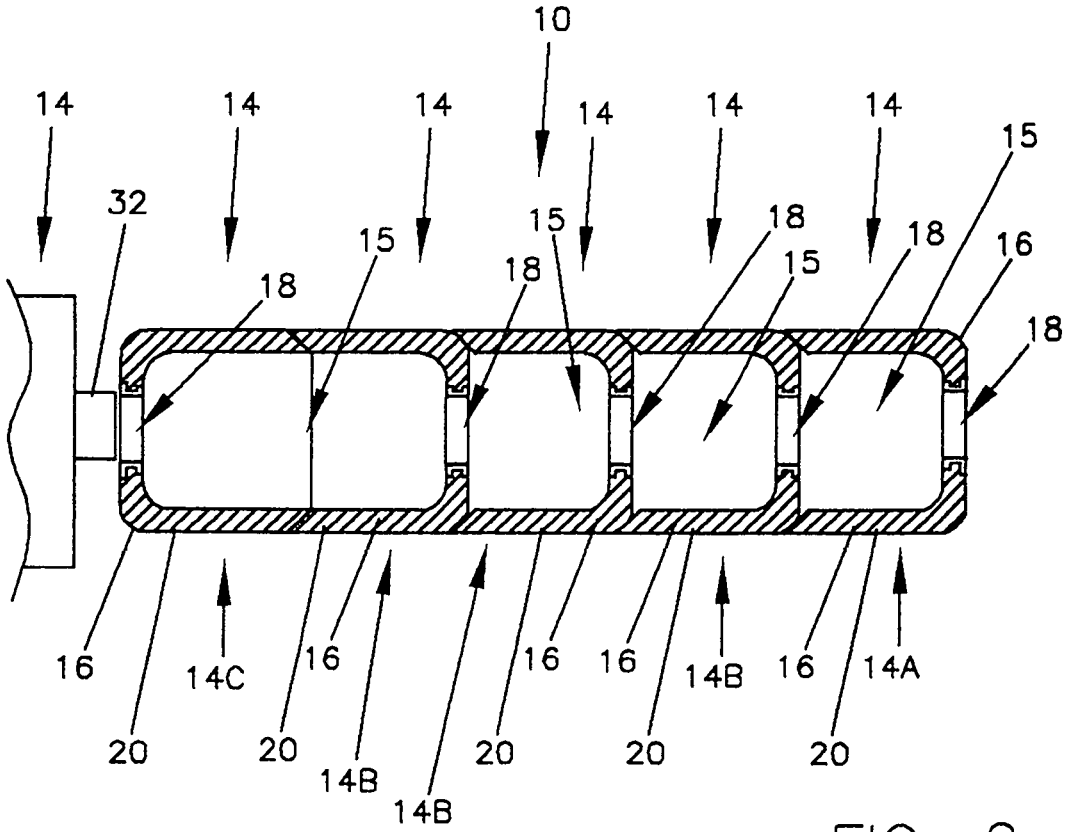
FIG. 2 is a cross-sectional side view of the firearm noise suppressor of the present invention.

As shown in FIGS. 1 and 2, the present invention relates to a firearm noise suppressor generally indicated as 10 for use with a firearm generally indicated as 12. Although a handgun is depicted, the firearm noise suppressor 10 can be used with long guns as well.

As best shown in FIG. 2, the firearm noise suppressor 10 comprises a plurality of axially aligned hardened cups or hollow members each generally indicated as 14 to cooperatively form a plurality of expansion chambers each indicated as 15. More particularly, as shown in FIGS. 2 and 3 the plurality of hardened cups or hollow members comprises a distal hardened cup or hollow member 14A, at least one interior hardened cup or hollow member 14B and a proximal hardened cup or hollow member 14C.

Figure 3:
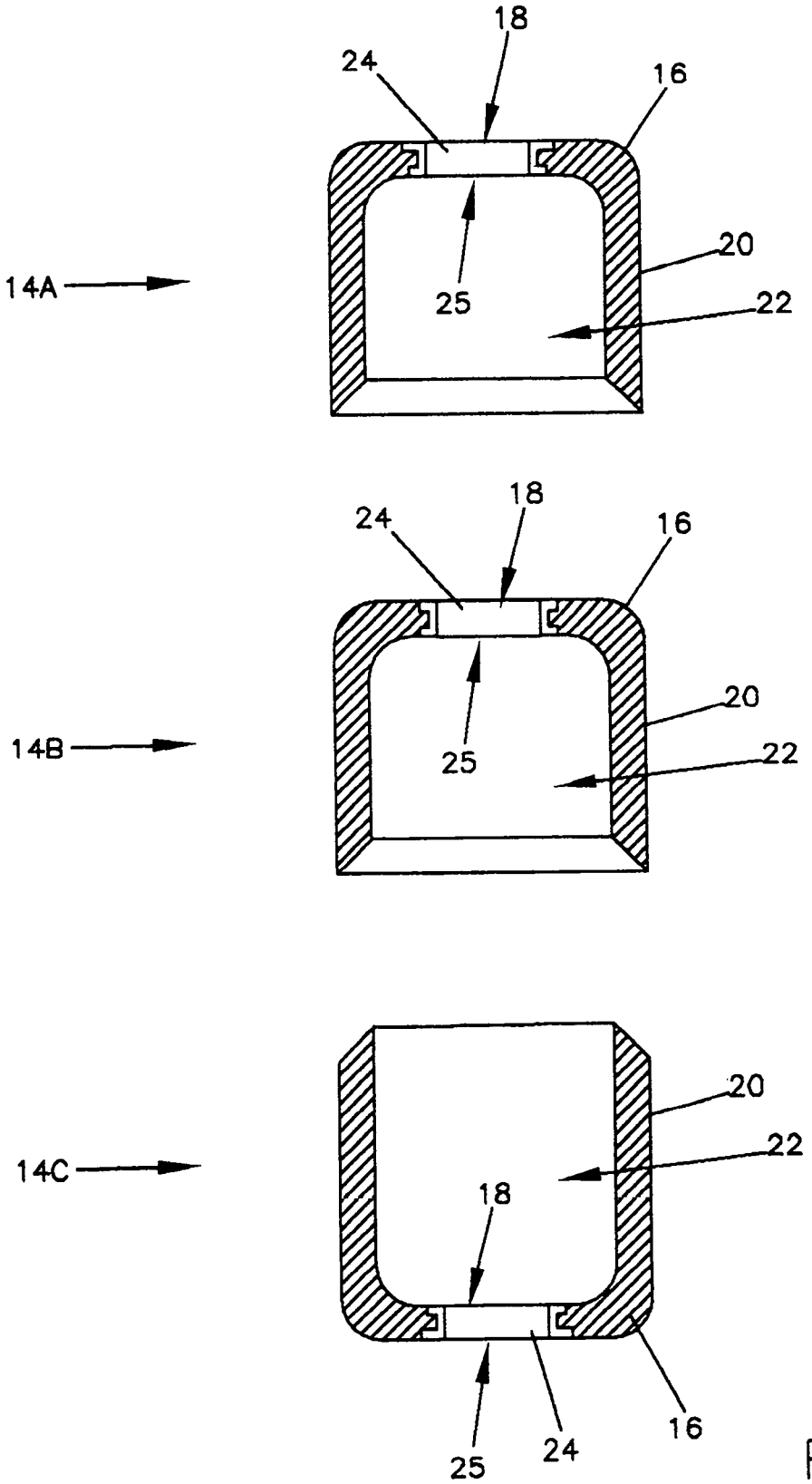
FIG. 3 is an exploded cross-sectional side view of the plurality of cup or hollow members of the present invention.

As best shown in FIG. 3, each hardened cup or hollow member 14A, 14B and 14C comprises a disk or end plate 16 including a centrally disposed aperture 18 formed therethrough having an annular skirt or apron 20 depending from the corresponding disk or end plate 16 to cooperatively form a cavity 22. When assembled, as shown in FIG. 2, the disk or end plate 16 and the annular skirt 20 of adjacent cup or hollow members 14 cooperatively form a corresponding expansion chamber 15. Since the proximal hardened cup or hollow member 14C is inverted with the disk or end plate 16 nearest the nozzle of the firearm 12, the proximal hardened cup or hollow member 14C and the next adjacent interior hardened cup or hollow member 14B cooperatively form an expansion chamber 15 larger than the other expansion chambers 15.

As shown in FIG. 3, an aperture reinforcing member or grommet 24 including a centrally disposed aperture 25 is secured to each disk or end plate 16 to protect the periphery of the corresponding centrally disposed aperture 18 of the corresponding hardened cup or hollow member 14.

As shown in FIGS. 4 and 5, the aperture reinforcing member or grommet 24A of the distal cup or hollow member 14A comprises an outer or distal ring or circular element 26A and an inner or proximal ring or circular element 28A cooperatively forming a retention groove 30A sized and configured to retain and secure the periphery of the corresponding centrally disposed aperture 18 of the corresponding hardened cup or hollow member 14A therein. As shown, the diameter of the outer or distal ring or element 26A may be greater than the diameter of the inner or proximal ring or element 28A.

As shown in FIGS. 6 and 7, the aperture reinforcing member or grommet 24B of the interior cup or hollow member 14B comprises an outer or distal ring or circular element 26B and an inner or proximal ring or element 28B cooperatively forming a retention groove 30B sized and configured to retain and secure the periphery of the corresponding centrally disposed aperture 18 of the corresponding hardened cup or hollow member 14B therein. As shown, the diameter of the outer or distal ring or element 26B may be substantially equal to the diameter of the inner or proximal ring or element 28B.

As shown in FIGS. 8 and 9, the aperture reinforcing member or grommet 24 of the proximal cup or hollow member 14C comprises an inner or distal ring or circular element 26C and an outer or proximal ring or circular element 28C cooperatively forming a retention groove 30C sized and configured to retain and secure the periphery of the corresponding centrally disposed aperture 18 of the corresponding hardened cup or hollow member 14C therein. As shown, the diameter of the outer or proximal ring or circular element 28C may be greater than the diameter of the inner or distal ring or element 26C.

The aperture reinforcing member or grommet 24C of the proximal cup or hollow member 14C comprises an internally threaded anchor nut to secure the firearm noise suppressor 10 to the muzzle by a threaded protrusion 32 on the firearm 12 shown in FIGS. 1 and 2.

As shown in FIG. 9, plurality of notches each indicated as 31 may be formed around the periphery of the outer or proximal ring 28C of the proximal cup or member 14C to create a mechanical locking interface between the aperture reinforcing member or grommet 24C and the periphery of the centrally disposed aperture 18 of the proximal hardened cup or hollow member 14C.

Figure 10:
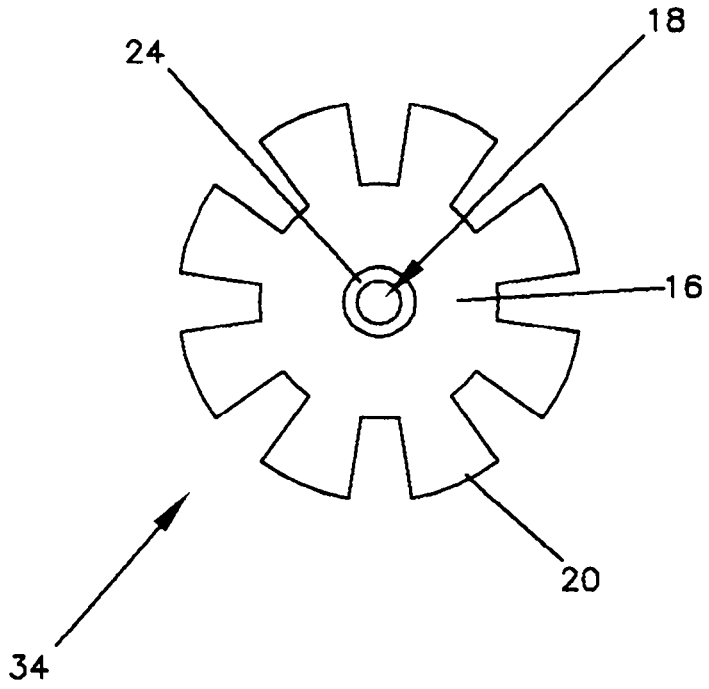
FIG. 10 is a top view of the blank and aperture reinforcing member integrally formed therewith from which the hardened cup or hollow member of the present invention is formed.

The hardened cups or hollow members 14A, 14B and 14C may be fabricated from a blank 34 of fibrous material (FIG. 10) comprising graphite, carbon, Kevlar, fiberglass or other similar commercially available fabric capable of absorbing a liquified resin which when hardened form the hardened cups or hollow members 14A, 14B or 14C. The resin may comprise polyimide, bismaleimide (BMI) or epoxy, or a combination of two (2) or more of these resins.

Figure 11:
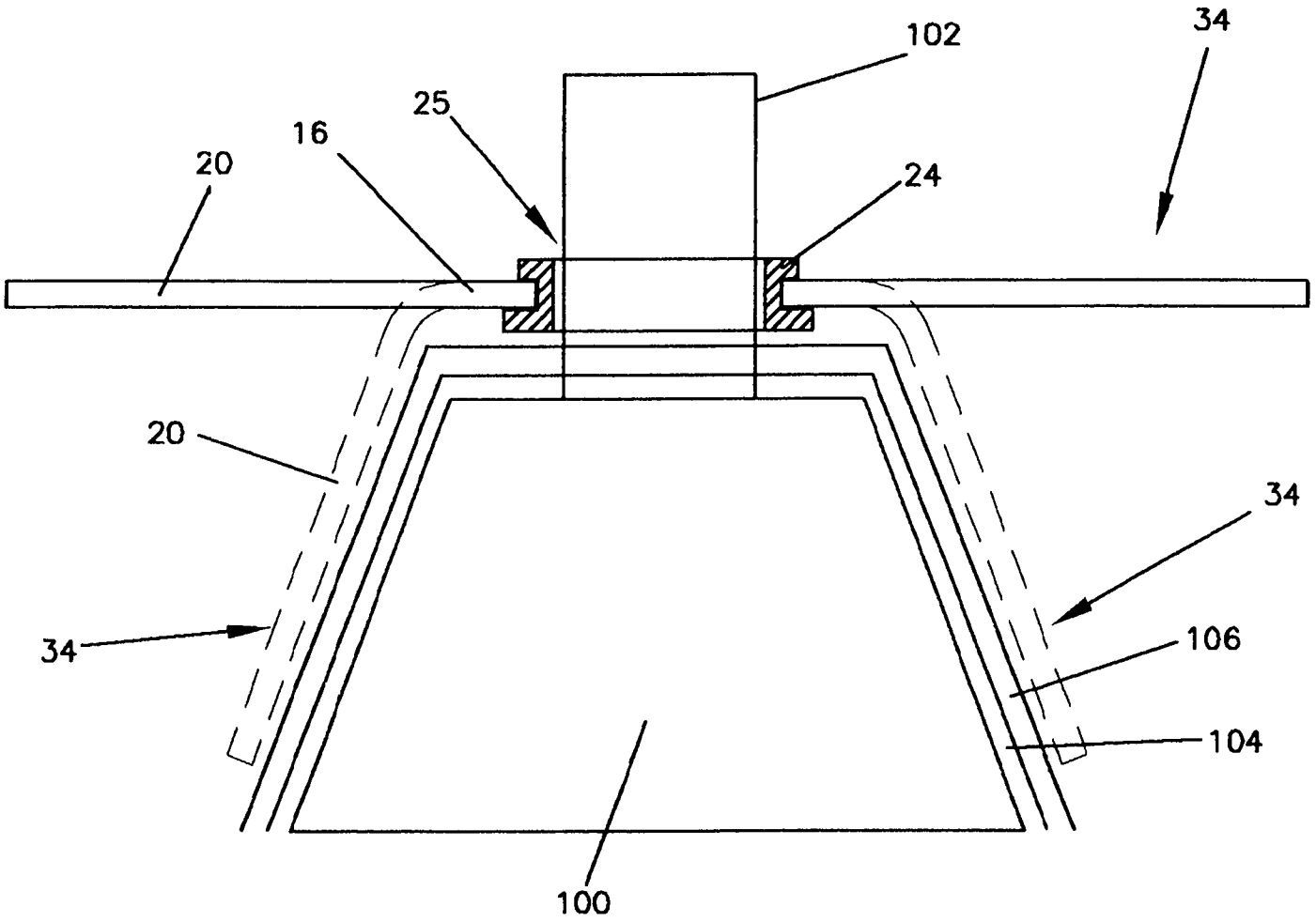
FIG. 11 is a side view of the blank fibrous material and aperture reinforcing member positioned on a mold to form or shape the blank into the fibrous material cup or hollow member of the present invention.
Figure 12:
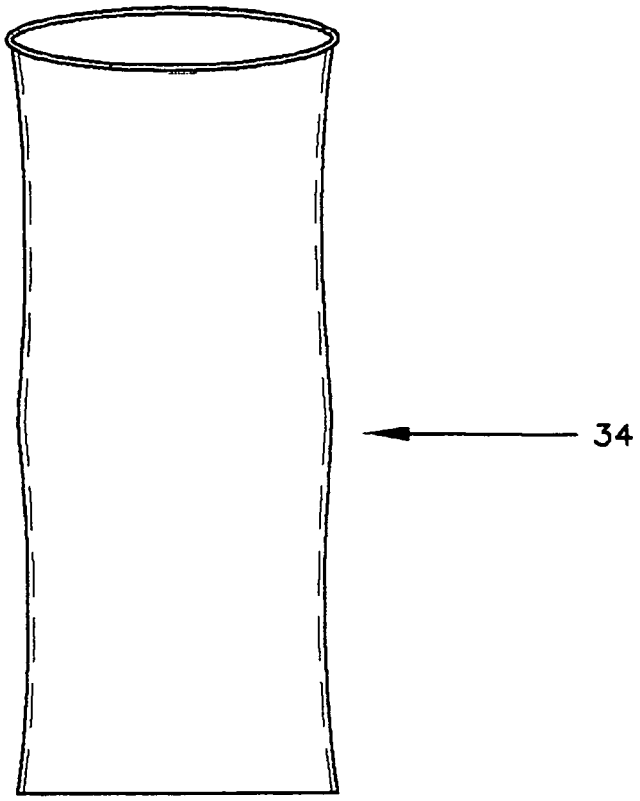
FIG. 12 is a perspective view of a fibrous sleeve from which an alternative embodiment of the fibrous cup or hollow member of the present invention is formed.

The method of producing the hardened cups or hollow members 14A, 14B and 14C from blanks of fibrous material 34 comprises the steps of (FIG. 11):

- creating a mold 100 having an alignment tool or post 102 extending upwardly therefrom upon which to shape a blank of fibrous material 34 into a fibrous cup or hollow member 14;
- placing a piece or sheet of nonstick film 104 onto the alignment tool 102 and over the mold 100;
- placing a piece or sheet of resin film 106 over the piece or sheet of nonstick film 104;
- positioning the blank of fibrous material 34 onto the alignment tool or post 102 and mold 100 by aligning the centrally disposed aperture 25 of the aperture reinforcing member or grommet 24 secured to the periphery of the centrally disposed aperture 18 of the blank 34 of fibrous material 34 on the alignment tool or post 102 extending upwardly from the mold 100;
- shaping or conforming the blank of fibrous material 34 to the mold 100 over the piece or sheet of resin film 106 and the piece or sheet of nonstick film 104 to form the cup or hollow member 14 comprising the disk or end plate 16 having the centrally disposed aperture 18 disposed in the center thereof and the skirt or apron 20 depending from the periphery of the disk or end plate 16 to form the corresponding cavity 22;

placing the cup or hollow member 14, piece or sheet of resin film 106 and piece or sheet of nonstick film 104, and mold 100 in an enclosure;

heating the enclosure to liquefy the piece or sheet of epoxy resin film 106 into the fibers of the blank of fibrous material 34 in the shape of the cup or hollow member 14 to impregnate the fibers with the liquified resin;

removing the cup or hollow member 14 and mold 100 from the enclosure;

allowing the resin to cure or harden to form the hardened cup or hollow member 14 and removing the hardened cup or hollow member 14 from the mold 100.

Alternatively, the blank of fibrous material 34 may be impregnated with resin eliminating the step of placing a sheet of resin fiber 106 onto the mold 100.

FIGS. 12 through 15 show an alternative method of fabricating the hardened cups or hollow members 14.

Specifically, the hardened cups or hollow members 14A, 14B and 14C may be fabricated from a sleeve of fibrous material 34 (FIG. 12) comprising graphite, carbon, Kevlar, fiberglass or other similar commercially available fabric capable of absorbing a liquified resin which when hardened form the hardened cups or hollow members 14A, 14B or 14C.

Figure 13:
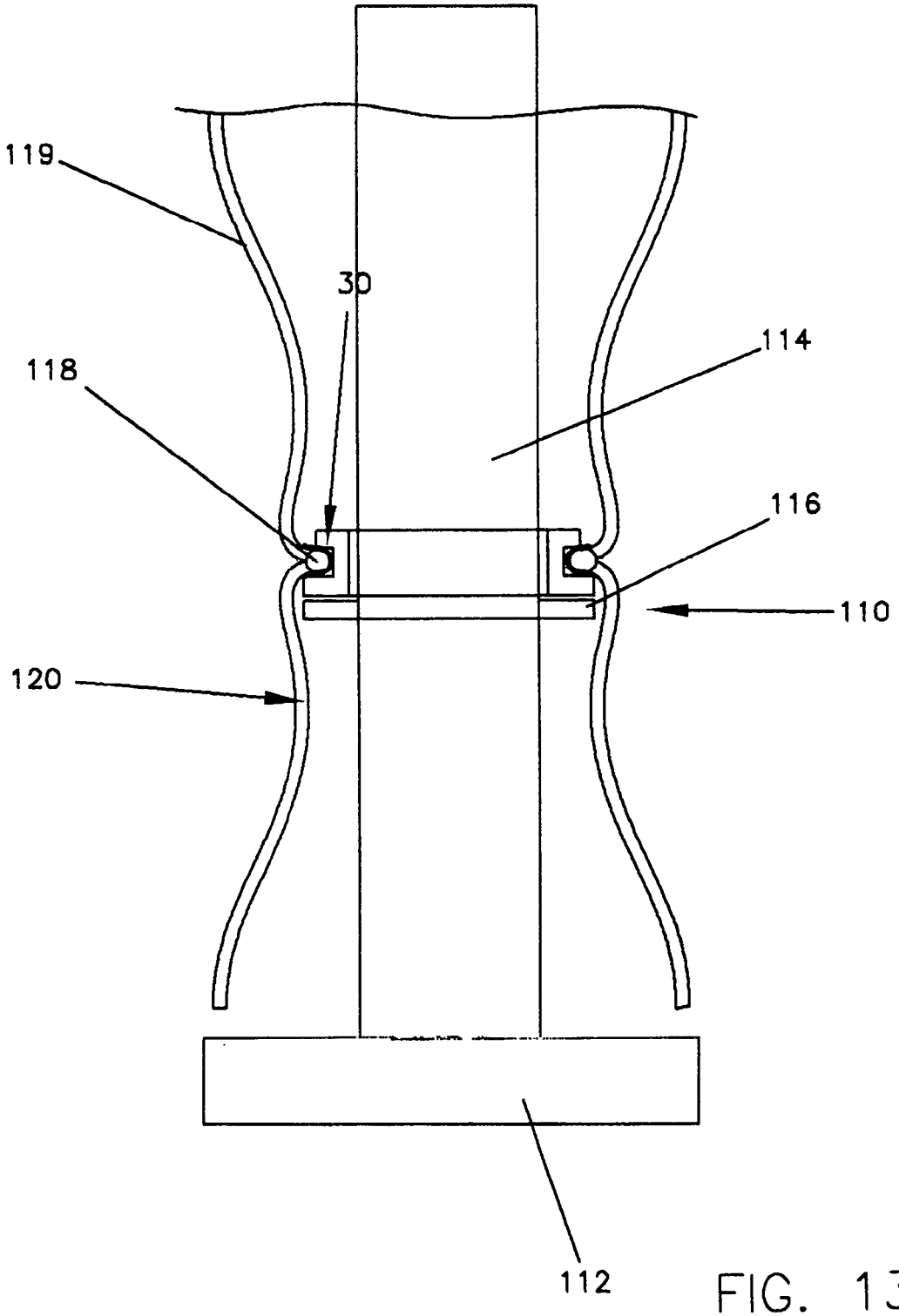
FIG. 13 is a side view of the fibrous sleeve and aperture reinforcing member of the present invention positioned on a jig to secure the fibrous sleeve to the aperture reinforcing member with a tie.
Figure 14:
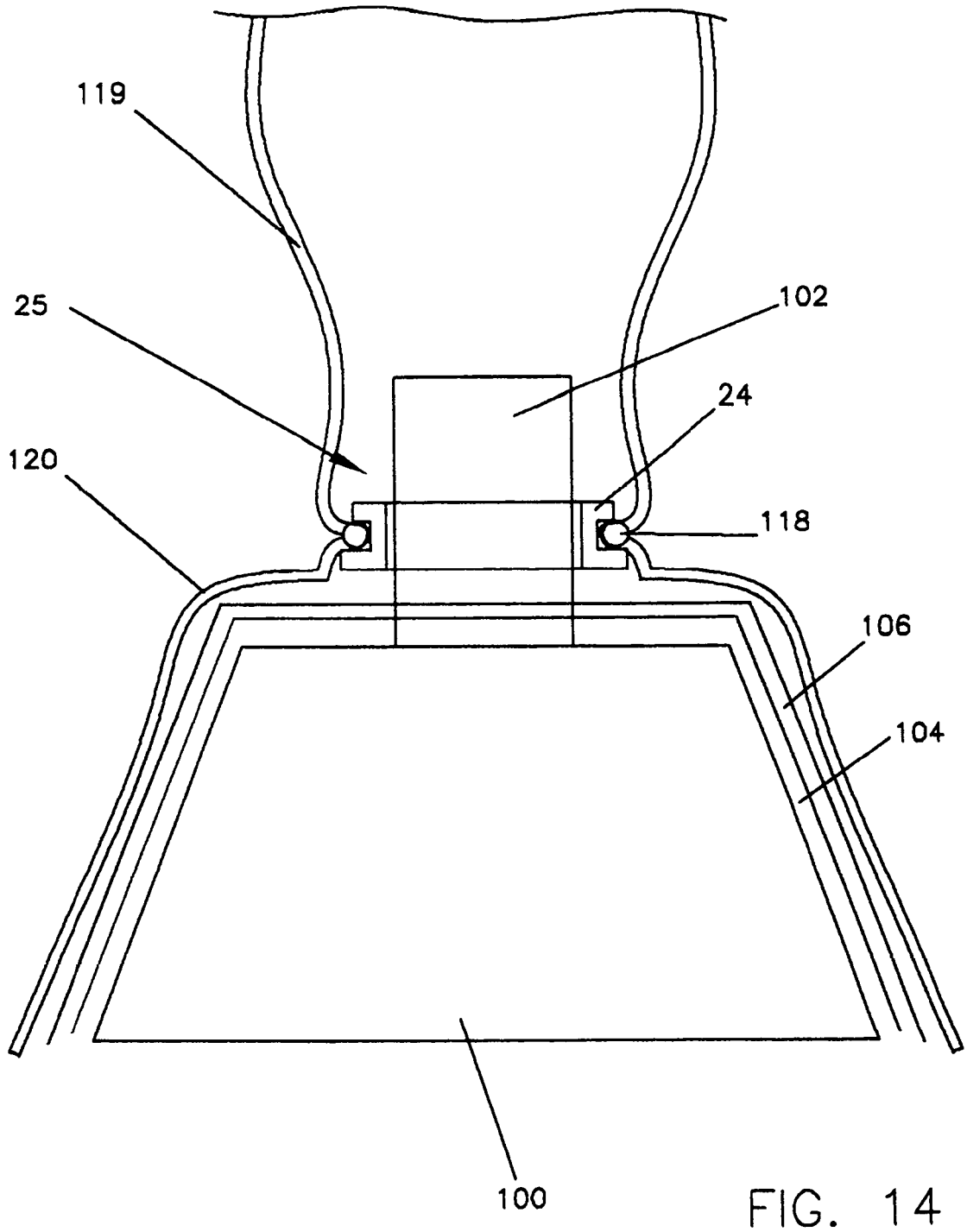
FIG. 14 is a side view of the fibrous sleeve and aperture reinforcing member secured together with the tie positioned on a mold to shape the fibrous sleeve into the alternate embodiment of the hardened fibrous cup or hollow member of the present invention.
Figure 15:
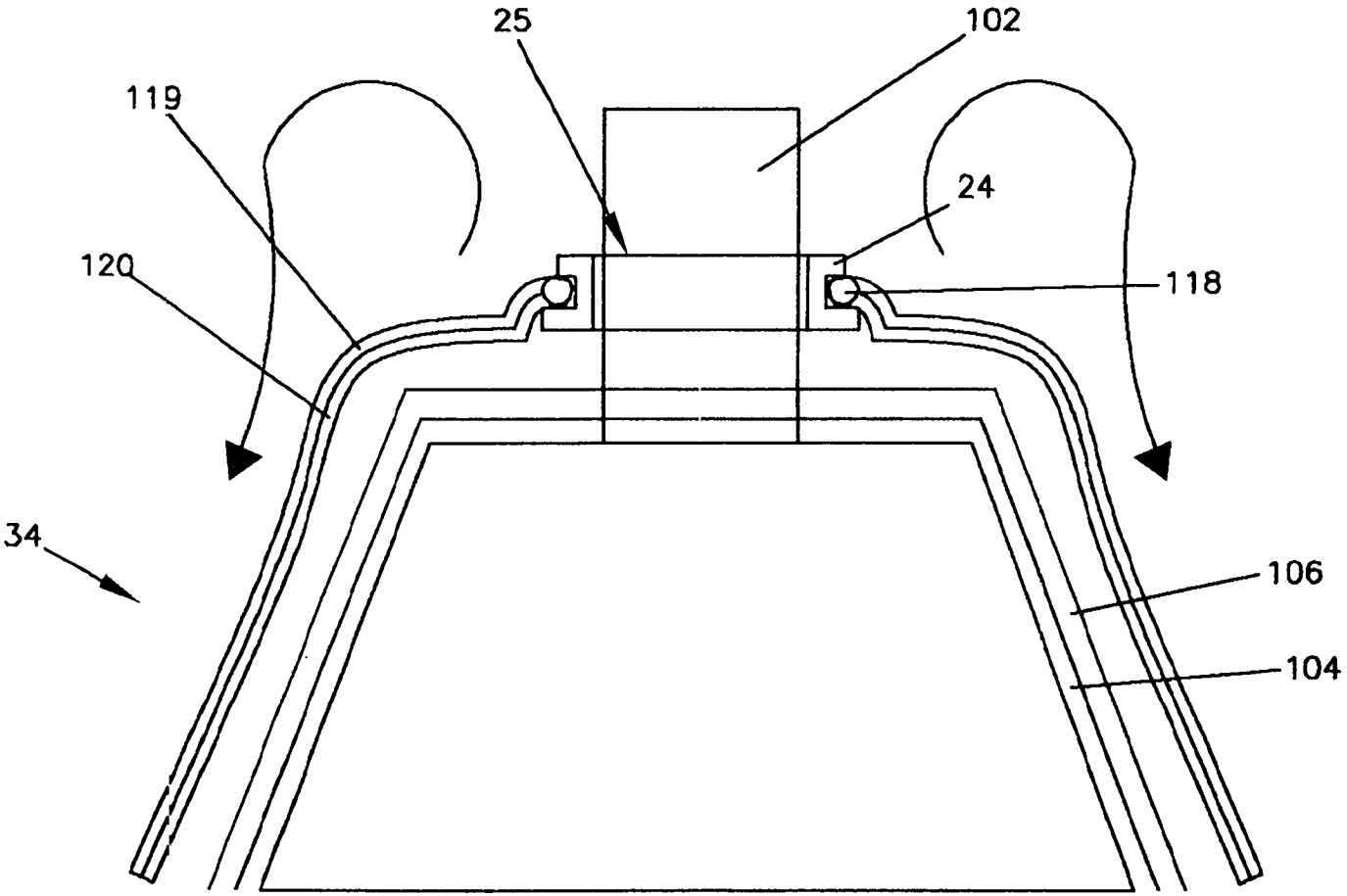
FIG. 15 is a side view of the fibrous sleeve and aperture reinforcing member secured together with the tie folded over on the mold to form a multi-layer hardened cup of hollow member of the present invention.

The method of producing the hardened cups or hollow members 14A, 14B and 14C from sleeves of fibrous material 34 comprises the steps of (FIGS. 12 through 15):

creating a jig 110 including a base 112 having a post 114 extending upwardly therefrom to support a shelf or platform 116 (FIG. 13);

placing an aperture reinforcing member or grommet 24 on the shelf or platform 116 (FIG. 13);

positioning a sleeve of fibrous material 34 over the post 114 of the jig 110 (FIG. 13);

securing the mid portion of the sleeve of fibrous material 34 in the retention groove 30 of the aperture reinforcing member or grommet 24 with a Kevlar tie 118 (FIG. 13);

creating a mold 100 having an alignment tool or post 102 extending upwardly therefrom upon which to shape the sleeve for fibrous material 34 into a fibrous cup or hollow member 14 (FIG. 14);

placing a piece or sheet of nonstick film 104 onto the alignment tool 102 and over the mold 100 (FIG. 14);

placing a piece or sheet of resin 106 over the piece or sheet of nonstick film 104 (FIG. 14);

positioning the sleeve of fibrous material 34 onto alignment tool 102 and mold 100 by aligning the centrally disposed aperture 25 of the aperture reinforcing member or grommet 24 secured to the periphery of the centrally disposed aperture 18 of the sleeve of fibrous material 34 on the alignment tool or post 102 extending upwardly from the mold 100 (FIG. 14);

folding the upper portion 118 of the sleeve of fibrous material 34 downward over the lower portion 120 of the sleeve of fibrous material 34 exposing the aperture reinforcing member or grommet 24 (FIG. 15);

shaping or conforming the folded sleeve of fibrous material 34 to the mold 100 to form a multi-layer cup or hollow member 14 comprising the disk or end plate 16 having the centrally disposed aperture 18 disposed in the center thereof and the skirt or apron 20 depending from the periphery of the disk or end plate 16 to form the corresponding cavity 22;

placing the multi-layer cup or hollow member 14, piece or sheet of resin film 106 and piece or sheet of nonstick film 104 and mold 100 in an enclosure;

heating the enclosure to liquefy the resin film 106 into the fibers of the multi-layered fibers of the sleeve or fibrous material 34 in the shape of the cup or hollow member 14 to impregnate the fibers with the liquefied resin;

removing the multi-layer cup or hollow member 14 and mold 100 from the enclosure;

allowing the resin to cure or harden to form the hardened cup or hollow member 14; and removing the hardened multi-layer cup or hollow member 14 from the mold 100.

Figure 16:
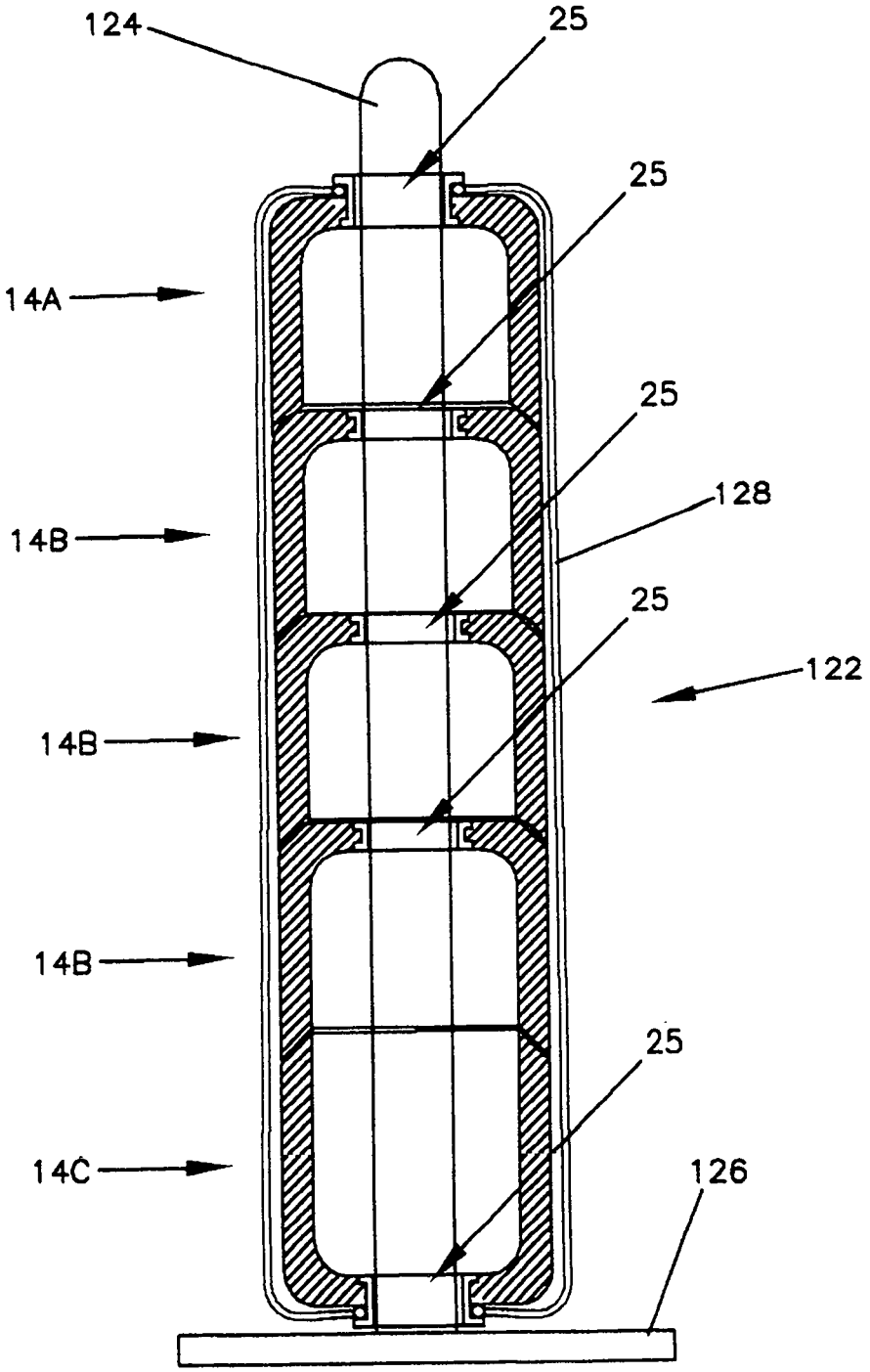
FIG. 16 is a cross-sectional side view of the plurality of stacked hardened cups or hollow members of the present invention assembled on a jig to apply an outer sheath to the stacked hardened cups or hollow members to bond the stacked hardened cups or hollow members together to form the firearm noise suppressor of the present invention.

The method of producing the firearm noise suppressor 10 comprises the steps of fabricating hardened cups or hollow members 14 and then bonding a plurality of the hardened cups or hollow members 14 within a hardened sheath or shell (FIG. 16).

In particular, as shown in FIG. 16 the steps of bonding a plurality of hardened cups or hollow members 14 within a hardened sheath or shell comprise:

stacking a plurality of hardened cups or hollow members 14 on a aligning jig 122 by placing each of the hardened cups or hollow members 14 on a post 124 extending up from a base 126 of the alignment jig 122 by passing the post 124 through the centrally disposed aperture reinforcing member or grommet 25 of each hardened cup or hollow member 14 such that the outer periphery of each annular skirt or apron 20 engages the adjacent hardened cup or hollow member 14 to cooperatively form a corresponding expansion chamber 15;

covering the plurality of stacked hardened cups or hollow members 14 with fibrous tubular braid 128 coated or embedded with a resin and/or plurality of single and multidirectional fibers coated with resin;

wrapping the proximal end portion of the proximal hardened cup or hollow member 14 with a unidirectional tie down;

placing the plurality of stacked and hardened cups or hollow members 14, fibrous tubular braid 128 and jig 122 in an enclosure;

heating the enclosure to liquefy the resin to bond the stacked hardened cups or hollow members 14 together;

removing the hardened cups or hollow members 14 and jig 122 from the enclosure;

allowing the resin on outer surface of the stacked hardened cups or hollow members 14 to cure and harden to create a composite sheath with the anchor nut secured to the proximal end portion thereof; and removing the firearm noise suppressor from the alignment tool.

Figure 17:
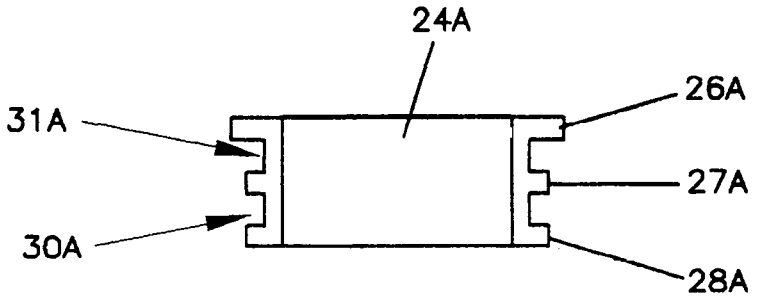
FIG. 17 is a side view of an alternative embodiment of the distal or exit aperture reinforcing member to be integrally formed with the distal cup or hollow member of the present invention.
Figure 18:
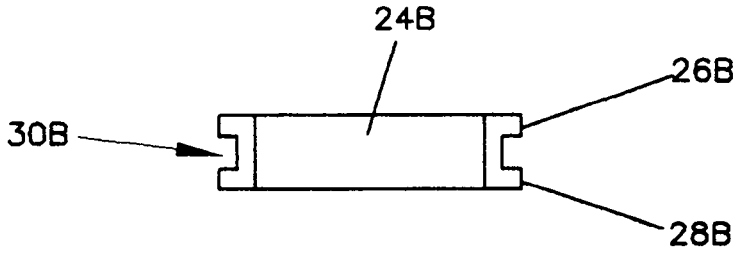
FIG. 18 is a side view of the internal aperture reinforcing member to be integrally formed with the internal cup or hollow member of the present invention.
Figure 19:
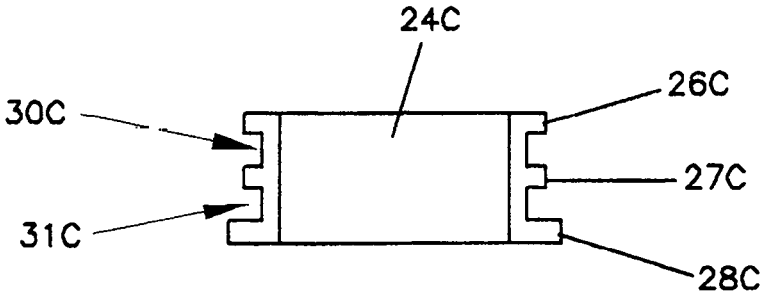
FIG. 19 is a side view of an alternate embodiment of the proximal or entry aperture reinforcing member to be integrally formed with the proximal cup or hollow member of the present invention.
Figure 20:
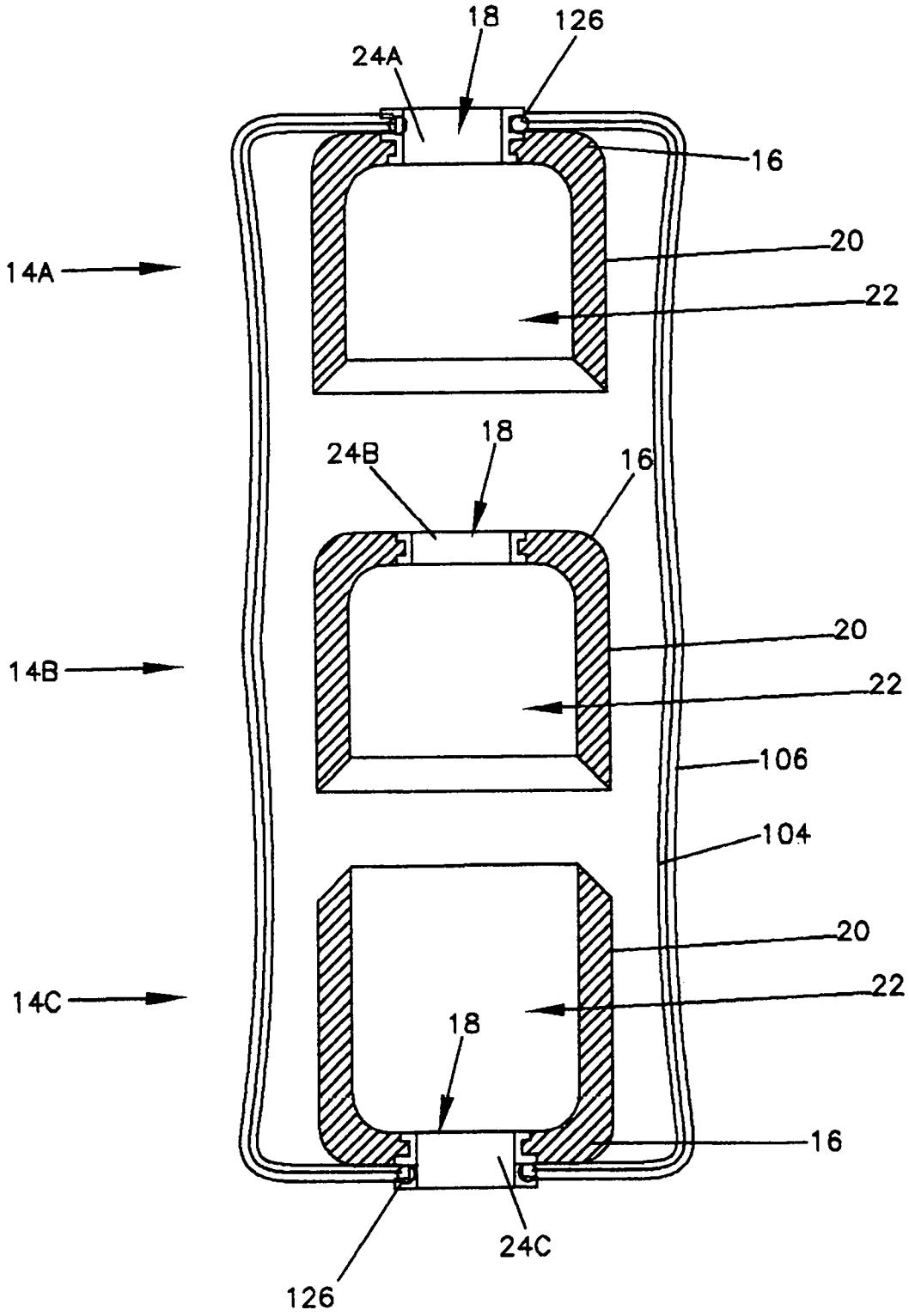
FIG. 20 is an exploded cross-sectional side view of the alternative embodiment of the firearm noise suppressor of the present invention.
Figure 21:
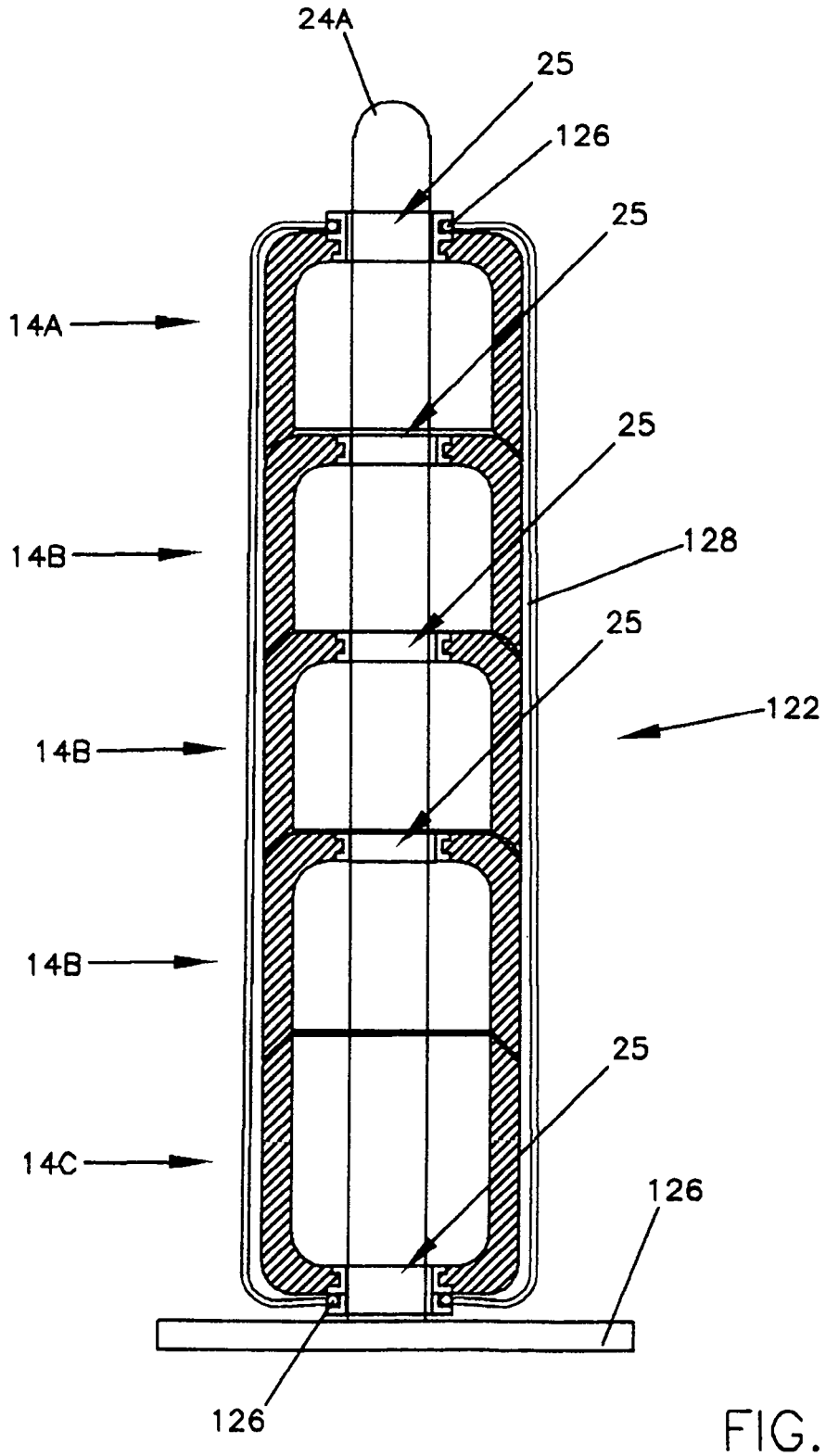
FIG. 21 is a cross-sectional side view of the plurality of stacked hardened cups or hollow members of the present invention assembled on a jig to apply an outer sheath to bond the stacked hardened cups or hollow members together to form the firearm noise suppressor of the present invention.

FIGS. 20 and 21 depict alternative methods of producing the firearm noise suppressor 10 using the aperture reinforcing members or grommets 24 shown in FIGS. 17 through 19.

Each of the aperture reinforcing members or grommets 24 secured to the periphery of the corresponding centrally disposed aperture 18 of the corresponding hardened cups or hollow members 14 includes a centrally disposed aperture 25.

As shown in FIG. 17, the aperture reinforcing member or grommet 24A of the distal cup or hollow member 14A comprises an outer or distal ring or element 26A, an intermediate ring or element 27A and an inner or proximal ring or element 28A cooperatively forming an inner retention groove 30A sized and configured to retain and secure the periphery of the corresponding centrally disposed aperture 18 of the corresponding hardened cup or hollow member 14A therein and an outer groove 31A. As shown, the diameter of the outer or distal ring or element 26A may be greater than the diameter of either the intermediate ring or element 27A or the inner or proximal ring or element 28A.

As shown in FIG. 18, the aperture reinforcing member or grommet 24B of the interior cup or hollow member 14B comprises an outer or distal ring or circular element 26B and an inner or proximal ring or element 28B cooperatively forming a retention groove 30B sized and configured to retain and secure the periphery of the corresponding centrally disposed aperture 18 of the corresponding hardened cup or hollow member 14B therein. As shown, the diameter of the outer or distal ring or element 26B may be substantially equal to the diameter of either the inner or proximal ring or element 28B.

As shown in FIG. 19, the aperture reinforcing member or grommet 24 of the proximal cup or hollow member 14C comprises an inner or distal ring or circular element 26C, an intermediate ring or circular element 27C and an outer or proximal ring or circular element 28C cooperatively forming an inner retention groove 30C sized and configured to retain and secure the periphery of the corresponding centrally disposed aperture 18 of the corresponding hardened cup or hollow member 14C therein and an outer groove 31C to receive the lower portion of an outer sleeve or shell 104/106 or 128 as discussed hereinafter. As show, the diameter of the outer proximal ring or element 28C may be greater than the diameters of the intermediate ring or element 27C and of the inner or distal ring or element 26C.

The aperture reinforcing member or grommet 24C comprises an internally threaded anchor nut to secure the firearm noise suppressor 10 to the muzzle by a threaded protrusion 32 on the firearm 12 shown in FIGS. 1 and 2.

Alternatives method of producing the firearm noise suppressor 10 comprises the steps of fabricating hardened cups or hollow members 14 and then bonding a plurality of the hardened cups or hollow members 14 within a hardened sheath or shell as shown in FIG. 20, depicts a separate layer of resin 104 and fabric 106; while FIG. 21 depicts a layer of fabric 128 impregnated with resin.

In particular, the steps of bonding a plurality of hardened cups or hollow members 14 within the hardened sheath or shell comprise:

stacking a plurality of hardened cups or hollow members 14 on a aligning jig 122 by placing each of the hardened cups or hollow members 14 on a post 124 extending up from a base 126 of the alignment jig 122 by passing the post 124 through the centrally disposed aperture reinforcing member or grommet 25 of each hardened cup or hollow member 14 such that the outer periphery of each annular skirt or apron 20 engages the adjacent hardened cup or hollow member 14 to cooperatively form a corresponding expansion chamber 15;

covering the plurality of stacked hardened cups or hollow members 14 with fibrous tubular braid 128 coated or embedded with a resin and/or plurality of single and multidirectional fibers coated with resin;

securing the upper end portion and lower end portion of the resin 104 and fabric 106 (FIG. 20) or resin impregnated fabric 128 (FIG. 21) into grooves 31A and 31C of grommets 24A and 24C respectively with a tie 126;

placing the plurality of stacked and hardened cups or hollow members 14, fibrous tubular braid 128 (FIG. 21) or separate layers of resin 104 and fabric 100, and jig 122 in an enclosure;

heating the enclosure to liquefy the resin to bond the stacked hardened cups or hollow members 14 together;

removing the hardened cups or hollow members 14 and jig 122 from the enclosure;

allowing the resin on outer surface of the stacked hardened cups or hollow members 14 to cure and harden to create a composite sheath with the anchor nut secured to the proximal end portion thereof; and removing the firearm noise suppressor from the alignment tool.

Figure 22:
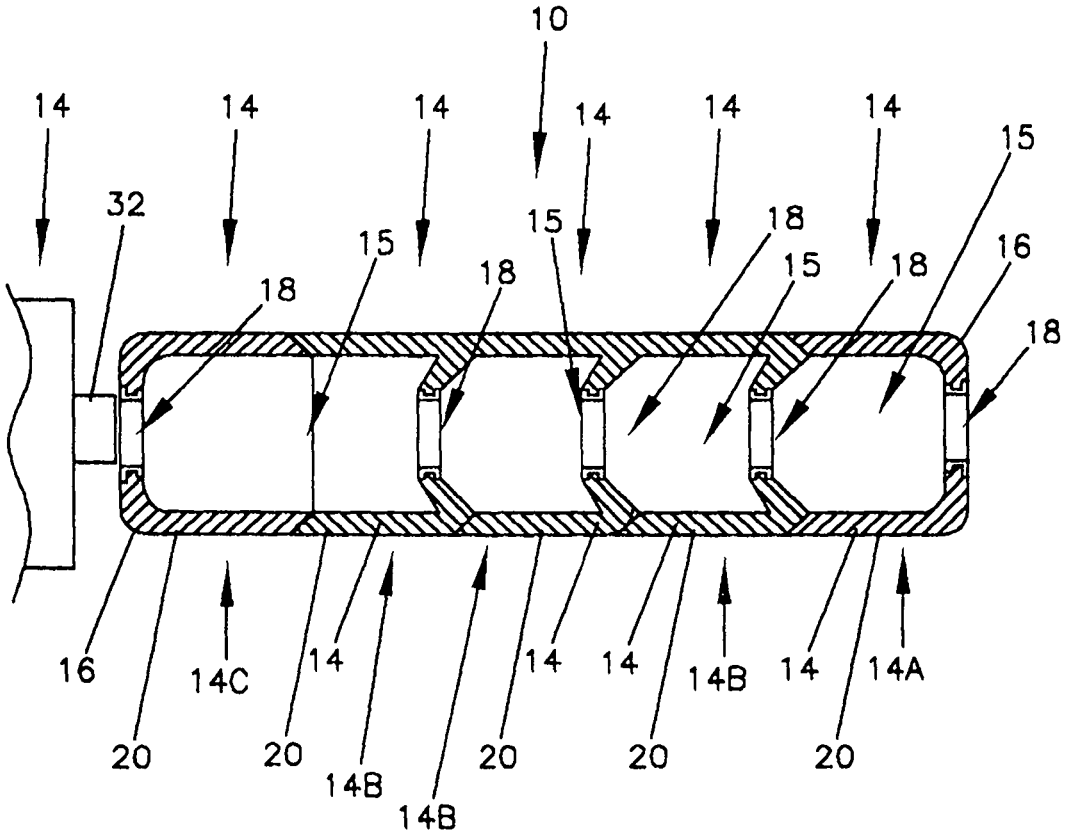
FIG. 22 is a cross-sectional side view of an alternate embodiment of the firearm noise suppressor of the present invention.

FIG. 22 depicts an alternate embodiment of the firearm noise suppressor 10 including a plurality of axially aligned hardened cups or hollow members each generally indicated as 14 to cooperatively form a plurality of expanded chambers each indicated as 15. The shape or configuration of the hardened cups or hollow members 14 is different from these shown in FIG. 2

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

In describing the invention, certain terms are used for brevity, clarity, and understanding. No unnecessary limitations should be inferred beyond the requirement of the prior art because such terms are used for descriptive purposes and are intended to be broadly construed. The different structural and functional elements, apparatuses, devices, compositions, and methods described herein may be used alone or in combination with other structural and functional elements, apparatuses, devices, compositions, systems and methods. It is to be expected that various equivalents, alternatives and modifications are possible within the scope of the claims hereinafter.

Now that the invention has been described.

What is claimed is:

1. A firearm noise suppressor comprising; a plurality of axially aligned fibrous hollow members constructed of fibrous hardened material impregnated with a resin, the fibrous hollow members cooperatively forming a plurality of expansion chambers encased in an outer sleeve of fibrous material impregnated with resin, each said fibrous hardened hollow member having a centrally disposed aperture formed therethrough, said centrally disposed apertures being axially aligned; where in each fibrous hardened hollow member contacts the next adjacent fibrous hardened hollow member such that said plurality of fibrous hollow members are bonded together by said outer sleeve of fibrous material impregnated with resin to form said firearm noise suppressor, said plurality of fibrous hardened hollow members comprise a distal fibrous hardened hollow member including a muzzle, at least one interior fibrous hardened hollow member and a proximal fibrous hardened hollow member, each said fibrous hardened hollow member further comprising an end plate including a centrally disposed aperture formed therethrough having an annular skirt or apron depending from said corresponding end plate to cooperatively form a cavity, and an aperture reinforcing member including a centrally disposed aperture is secured to each said end plate to protect the periphery to the corresponding centrally disposed aperture of the corresponding fibrous hardened hollow member; and wherein said proximal fibrous hardened hollow member is inverted with said end plate nearest a muzzle of the firearm, the annular skirt of said proximal fibrous hardened hollow member and the annular skirt of the next adjacent interior fibrous hardened hollow member in contact so as to cooperatively form an expansion chamber larger than the other expansion chambers; and wherein said aperture reinforcing member of said proximal fibrous hardened hollow member comprises an internally threaded anchor nut to secure said firearm noise suppressor to the muzzle by a threaded protrusion on the firearm.

2. The firearm noise suppressor of claim 1 wherein when assembled, said end plate and annular skirt of adjacent fibrous hardened hollow members cooperatively form corresponding expansion chambers.

3. The firearm noise suppressor of claim 1 wherein said aperture reinforcing member of the distal fibrous hardened hollow member comprises an outer ring element and an inner ring element cooperatively forming a retention groove sized and configured to retain and secure the periphery of the corresponding centrally disposed aperture of the corresponding fibrous hardened hollow member therein.

4. The firearm noise suppressor of claim 3 wherein the diameter of said outer ring element is greater than the diameter of said inner ring element.

5. The firearm noise suppressor of claim 3 wherein said aperture reinforcing member of the interior fibrous hardened hollow member comprises an outer ring element and an inner ring element cooperatively forming a retention groove sized and configured to retain and secure the periphery of the corresponding centrally disposed aperture of the corresponding fibrous hardened hollow member therein.

6. The firearm noise suppressor of claim 5 wherein said diameter of said outer ring element is substantially equal to the diameter of said inner ring element.

7. The firearm noise suppressor of claim 5 wherein said aperture reinforcing member of said proximal fibrous hardened hollow member comprises an inner ring element and an outer ring element cooperatively forming a retention groove sized and configured to retain and secure the periphery of the corresponding centrally disposed aperture of the corresponding fibrous hardened hollow member therein.

8. The firearm noise suppressor of claim 7 wherein the diameter of said outer ring element is greater than the diameter of said inner ring element.

9. The firearm noise suppressor of claim 6 wherein said plurality of notches are formed around the periphery of said outer ring element said proximal fibrous hardened hollow member to create a mechanical locking interface between said aperture reinforcing member and the periphery of said centrally disposed aperture of said proximal fibrous hardened hollow member.

10. The firearm noise suppressor of claim 1 wherein said fibrous hardened hollow members are fabricated from a blank of fibrous material selected from graphite, carbon, Kevlar or fiberglass and liquified resin absorbed and hardened to form said fibrous hardened hollow members.

11. The firearm noise suppressor of claim 10 wherein said resin is selected from polyimide, bismaleimide (BMI) or epoxy, or a combination thereof.

* * * * *